US012071818B2

(12) United States Patent
Sauvageau et al.

(10) Patent No.: US 12,071,818 B2
(45) Date of Patent: Aug. 27, 2024

(54) MECHANICAL ATTACHMENT OF CUTTING ELEMENTS TO AN EARTH-BORING BIT

(71) Applicant: National Oilwell DHT, L.P., Houston, TX (US)

(72) Inventors: Richard Sauvageau, Conroe, TX (US); Konstantin Morozov, The Woodlands, TX (US); Bradley Ivie, The Woodlands, TX (US)

(73) Assignee: NATIONAL OILWELL DHT, L.P., Houston, TX (US)

( * ) Notice: Subject to any disclaimer, the term of this patent is extended or adjusted under 35 U.S.C. 154(b) by 115 days.

(21) Appl. No.: 17/774,102

(22) PCT Filed: Nov. 2, 2020

(86) PCT No.: PCT/US2020/058579
§ 371 (c)(1),
(2) Date: May 3, 2022

(87) PCT Pub. No.: WO2021/091834
PCT Pub. Date: May 14, 2021

(65) Prior Publication Data

US 2022/0389769 A1 Dec. 8, 2022

Related U.S. Application Data

(60) Provisional application No. 62/931,359, filed on Nov. 6, 2019, provisional application No. 62/938,669, filed on Nov. 21, 2019.

(51) Int. Cl.

| | |
|---|---|
| ***E21B 10/633*** | (2006.01) |
| ***E21B 10/43*** | (2006.01) |
| ***E21B 10/573*** | (2006.01) |

(52) U.S. Cl.
CPC ..... *E21B 10/633* (2013.01); *E21B 10/43* (2013.01); *E21B 10/573* (2013.01)

(58) Field of Classification Search
CPC ..... E21B 10/633; E21B 10/43; E21B 10/52; E21B 10/567; E21B 10/573; E21B 10/627; E21B 10/5673
See application file for complete search history.

(56) References Cited

U.S. PATENT DOCUMENTS 5,533,582 A 7/1996 Tibbitts
8,881,849 B2 11/2014 Shen et al.
(Continued)

OTHER PUBLICATIONS

International Search Report and Written Opinion of corresponding International application serial No. PCT/US2020/058579, mailed on Mar. 4, 2021, 13 pages.
(Continued)

*Primary Examiner* — Caroline N Butcher
(74) *Attorney, Agent, or Firm* — Porter Hedges LLP; Jonathan Pierce; Pierre Campanac

(57) ABSTRACT

Methods for attaching cutting elements to an earth-boring bit rely on keying the cutting elements inside cavities formed in the earth-boring bit. The attachment methods may involve specific shapes of the cutting elements and the cavities in which the cutting elements are received, and/or mechanical retainers. Preferably, the blade of the earth-boring bit is thicker around the opening in the edge of the blade than when the cavity is shaped for receiving a cutting element that has a circular cross-section.

13 Claims, 11 Drawing Sheets

(56) References Cited

U.S. PATENT DOCUMENTS

| | | | | |
|---|---|---|---|---|
| 8,991,523 | B2 | 3/2015 | Shen et al. | |
| 9,016,409 | B2 | 4/2015 | Zhang et al. | |
| 9,187,962 | B2 | 11/2015 | Burhan et al. | |
| 9,284,790 | B2 | 3/2016 | Zhang et al. | |
| 9,322,219 | B2 | 4/2016 | Burhan et al. | |
| 9,624,731 | B2 | 4/2017 | Haugvaldstad et al. | |
| 2007/0158115 | A1* | 7/2007 | Sherwood, Jr. | E21B 10/55 175/426 |
| 2009/0020339 | A1 | 1/2009 | Sherwood, Jr. | |
| 2009/0038442 | A1 | 2/2009 | Shamburger et al. | |
| 2009/0158898 | A1 | 6/2009 | Sherwood, Jr. et al. | |
| 2010/0258355 | A1 | 10/2010 | De Maindreville et al. | |
| 2010/0314176 | A1* | 12/2010 | Zhang | E21B 10/567 175/428 |
| 2011/0297454 | A1* | 12/2011 | Shen | E21B 10/633 175/431 |
| 2013/0015000 | A1* | 1/2013 | Zhang | E21B 10/56 175/428 |
| 2013/0146367 | A1 | 6/2013 | Zhang et al. | |
| 2016/0153243 | A1* | 6/2016 | Hinz | E21B 10/633 175/413 |
| 2018/0195351 | A1* | 7/2018 | Grosz | E21B 10/43 |
| 2018/0274302 | A1 | 9/2018 | Zhang et al. | |
| 2018/0355672 | A1 | 12/2018 | De Maindreville et al. | |
| 2019/0032415 | A1 | 1/2019 | Bomidi et al. | |

OTHER PUBLICATIONS

Extended European Search report in counterpart application serial No. 20 885 023.0, mailed on Oct. 2, 2023, 8 pages.

* cited by examiner

MECHANICAL ATTACHMENT OF CUTTING ELEMENTS TO AN EARTH-BORING BIT

CROSS-REFERENCE TO RELATED APPLICATIONS

This application is a U.S. national stage application under 35 U.S.C. § 371 of International Application Serial No. PCT/US2020/058579, filed on Nov. 2, 2020, which claims priority to U.S. Provisional Application Ser. No. 62/938,669, filed on Nov. 21, 2019, and to U.S. Provisional Application Ser. No. 62/931,359, filed on Nov. 6, 2019. International Application Serial No. PCT/US2020/058579, U.S. Provisional Application Ser. No. 62/938,669, and U.S. Provisional Application Ser. No. 62/931,359 are incorporated by reference herein for all and any purposes.

This application also claims the benefit of priority to U.S. application Ser. No. 62/938,669, filed on Nov. 21, 2019, which is incorporated herein by reference for all purposes.

BACKGROUND

This disclosure relates generally to earth-boring bits. This disclosure relates more particularly to earth-boring bits in which one or more cutting elements are attached using mechanical means.

FIG. 1 illustrates a portion of a known earth-boring bit. The earth-boring bit comprises blades, such as blade 10. Each blade extends axially and radially from a body, which is not shown in FIG. 1. In use, the body is coupled to a drill string and rotated around an axis in a direction indicated by arrow 100 in FIG. 1. The blade 10 has a leading face 16, which is the face of the blade 10 that is intended to lead when the body of the earth-boring bit is rotated, and a trailing face, which is the face of the blade 10 that is intended to trail when the body of the earth-boring bit is rotated. A surface spanning between the leading face 16 and trailing face is referred to herein as an edge 18 of the blade 10.

The blade 10 has cavities formed in it, such as cavity 12. Each cavity is shaped to receive a portion of a cutting element 14. The cutting element 14 typically has a longitudinal axis 24 passing through its center, and a cross-section that is circular. The cutting element 14 typically includes an ultra-hard table 20 (e.g., made of sintered polycrystalline diamond) attached to a substrate 22 (e.g., made of sintered tungsten carbide). The ultra-hard table 20 has a cutting face 21 and a cutting edge 23. Once introduced in the cavity 12, the cutting element 14 protrudes from the cavity 12 through a first opening in the edge 18 of the blade 10 as well as through a second opening in the leading face 16 of the blade 10. As such, a surface of the cutting element 14 is exposed so that the cutting element 14 can crush or shear the rock without the blade 10 rubbing excessively on the rock. However, the shape of the cavity 12 is not sufficient to retain the cutting element 14 inside the cavity 12.

In order to retain the cutting element 14 inside the cavity 12, the cutting element 14 is brazed to the blade 10 using a metal filler, which is shown disposed on a wall 26 of the cavity 12 in FIG. 1. The cutting element 14 is positioned in the cavity 12 with the metal filler. The metal filler is melted in place, infiltrates the substrate 22 of the cutting element 14 and the blade 10. Thus, the cutting element 14 and the blade 10 are subjected to a heating cycle when the cutting element 14 is attached to (or detached from) the blade 10.

This heating cycle may damage the cutting element 14 and the blade 10. As such, there is a continuing need in the art for alternative methods for attaching cutting elements to an earth-boring bit that preferably do no subject the cutting elements and the earth-boring bit to a heating cycle.

BRIEF SUMMARY OF THE DISCLOSURE

The disclosure describes an earth-boring bit, which comprises a body having a rotational axis, and a blade extending axially and radially from the body, the blade having a leading face and an edge. A cavity is formed in the blade. The cavity leads to a first opening in the edge of the blade and a second opening in the leading face of the blade.

In some embodiments, the cavity may be configured to receive a cutting element through the first opening. The cavity may be configured to receive a retainer through the first opening also, preferably after the cutting element is engaged with the portion of the wall of the cavity such that the retainer is capable of abutting the cutting element and a back wall of the cavity. The retainer may be releasably attached to the blade. For example, the retainer may comprise a shim releasably attached to the blade by using a screw, an adhesive, or brazing.

In some embodiments, the cutting element may have a cylindrical lateral surface and a flared lateral surface that points inwards in a direction toward a cutting face of the cutting element. A portion of a wall of the cavity may be complementary to the shape of the flared lateral surface of the cutting element. Furthermore, the cutting element is prevented from rotating inside the cavity after the flared lateral surface of the cutting element is engaged with the portion of the wall of the cavity.

In some embodiments, the cutting element may consist of a table of sintered polycrystalline diamond from which a transition metal used as a sintering catalyst is essentially entirely leached or otherwise removed from the pores of a polycrystalline diamond matrix that are connected to an outer surface of the table.

In some embodiments, the cutting element may have a rotational symmetry of order two or more around a longitudinal axis.

In some embodiments, the blade may include a fixed portion and a plate, the fixed portion being integral to the bit body, the plate being releasably attached to the fixed portion. A lateral surface of the plate may be at least partially forming the edge of the blade after the plate is releasably attached to the fixed portion. The cavity may be formed at least partially into the plate. The fixed portion of the blade may be abutting the cutting element.

In some embodiments, a first section of the cutting element that is perpendicular to the longitudinal axis may have a first contour line that includes a first line portion, a second line portion, a third line portion, and optionally a fourth line portion. The first line portion may have a first endpoint and a second endpoint that is offset from the first endpoint, the first endpoint of the first line portion being located at a first predetermined radius from the longitudinal axis, the first line portion being tangent to a circle centered on the longitudinal axis and having the first predetermined radius, the first line portion having curvatures that have a constant sign and magnitudes larger than the inverse of the first predetermined radius, the second endpoint of first line portion being located at a distance from the longitudinal axis that is shorter than the first predetermined radius. The second line portion may have a first endpoint and a second endpoint that is offset from the first endpoint, the first endpoint of the second line portion being co-located with the second endpoint of the first line portion, the second line portion being tangent to the first line portion, the second line portion being smooth, all points of the second line portion being located at distances from the longitudinal axis that are shorter than or equal to the first predetermined radius. The third line portion may have a first endpoint and a second endpoint that is offset from the first endpoint, the first endpoint of the third line portion being co-located with the second endpoint of the second line portion, the third line portion being tangent to the second line portion, the third line portion having curvatures that have a constant sign and magnitudes larger than the inverse of the first predetermined radius, the second endpoint of the third line portion being located at first the predetermined radius from the longitudinal axis, the third line portion being tangent to the circle centered on the longitudinal axis and having the first predetermined radius. The fourth line portion may have a first endpoint and a second endpoint that is offset from the first endpoint, the first endpoint of the fourth line portion being co-located with the second endpoint of the third line portion, the fourth line portion being an arc of the circle centered on the longitudinal axis and having the first predetermined radius. The first line portion may be adjacent to the wall of the cavity so that the cutting element is mechanically retained in the cavity formed in the blade. The third line portion and the fourth line portion may protrude from the first opening of the cavity so that a first surface of the cutting element is exposed.

In some embodiments, the cutting element may include an ultra-hard table attached to a substrate, the substrate having a lateral surface portion forming a keyseat, a lateral surface portion that is cylindrical, and a lateral surface including a concave depression. The concave depression may be surrounded by a corner. Optionally, an entirety of the ultra-hard table may have a circular perimeter. A portion of a wall of the cavity may be configured to form a complementary key such that the cutting element is prevented from rotating inside the cavity after the keyseat is engaged with the key. A through-hole may be formed in the substrate of the cutting element. The through-hole may lead to the concave depression.

In some embodiment, the earth-boring bit may comprise a retainer that is releasably attached to the blade, the retainer being positioned in the cavity and movable between a first position wherein the retainer is engaging a concave depression so that the cutting element is mechanically retained in the blade, and a second position wherein the retainer is offset from the concave depression so that the cutting element can be released from the blade. For example, the retainer can be moved from the first position to the second position with an elongated tool penetrating the through-hole. The retainer may comprise a ball or peg and a spring, the spring being disposed between the wall of the cavity and the ball or peg, or wherein the retainer comprises a threaded setscrew engaged with threads formed on the wall of the cavity.

In some embodiments, the cutting element may have a funneled lateral surface such that the cutting element includes a first longitudinal portion having a first central axis, and a second longitudinal portion having a second central axis. The second central axis may be parallel to and offset from, the first central axis such that a first section of the first longitudinal portion that is perpendicular to the first central axis has a first maximum width, a second section of the second longitudinal portion that is perpendicular to the second central axis has a second maximum width, and the second maximum width is smaller than the first maximum width. The first longitudinal portion of the cutting element may protrude from the cavity through the first opening and through the second opening. The second longitudinal portion of the cutting element may be entirely recessed into the blade.

BRIEF DESCRIPTION OF THE DRAWINGS

For a more detailed description of the embodiments of the disclosure, reference will now be made to the accompanying drawings, wherein.

DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

This disclosure describes methods for attaching cutting elements to an earth-boring bit that rely on keying the cutting elements inside cavities formed in the earth-boring bit, but may not rely on brazing. The attachment methods may involve specific shapes of the cutting elements and the cavities in which the cutting elements are received, and/or mechanical retainers.

Figure 1:
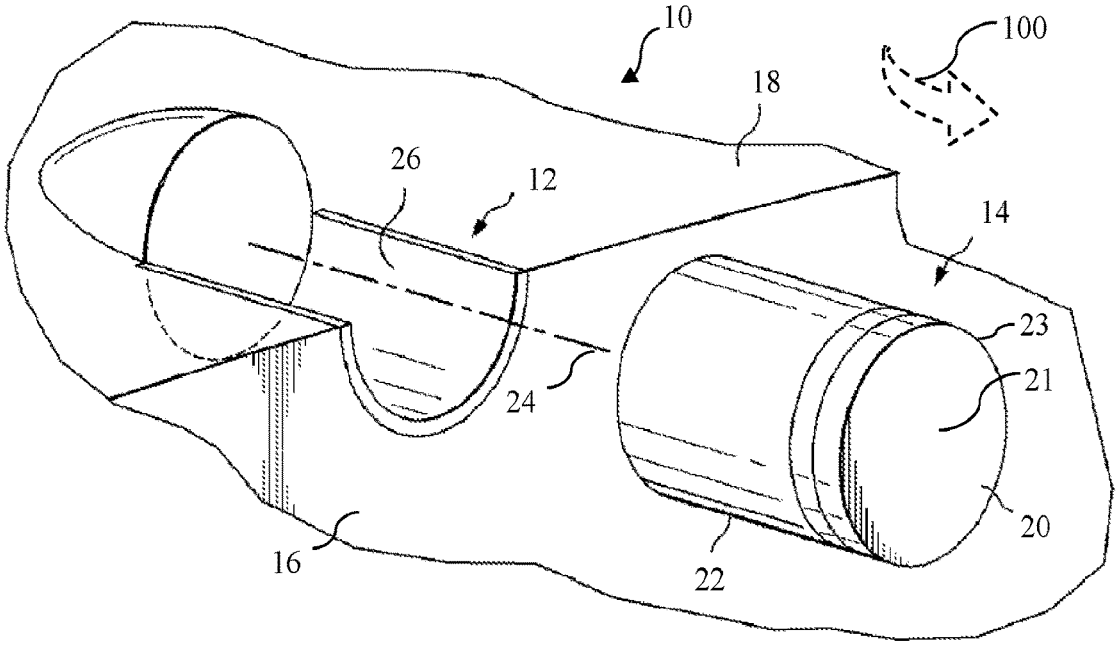
FIG. 1 (prior art)
FIG. 1 is a perspective view of a portion of a known earth-boring bit.
Figure 2:
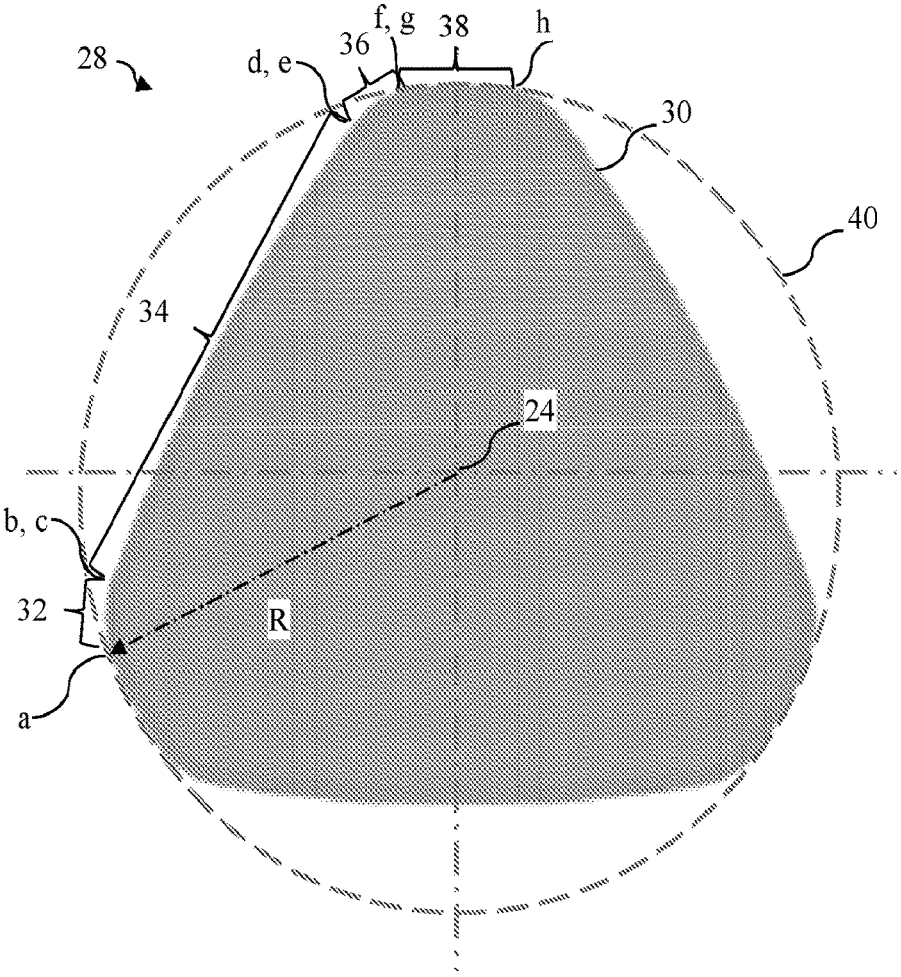
FIG. 2 is a schematic view of an example of a cross-sectional shape of a cutting element.
Figure 3:
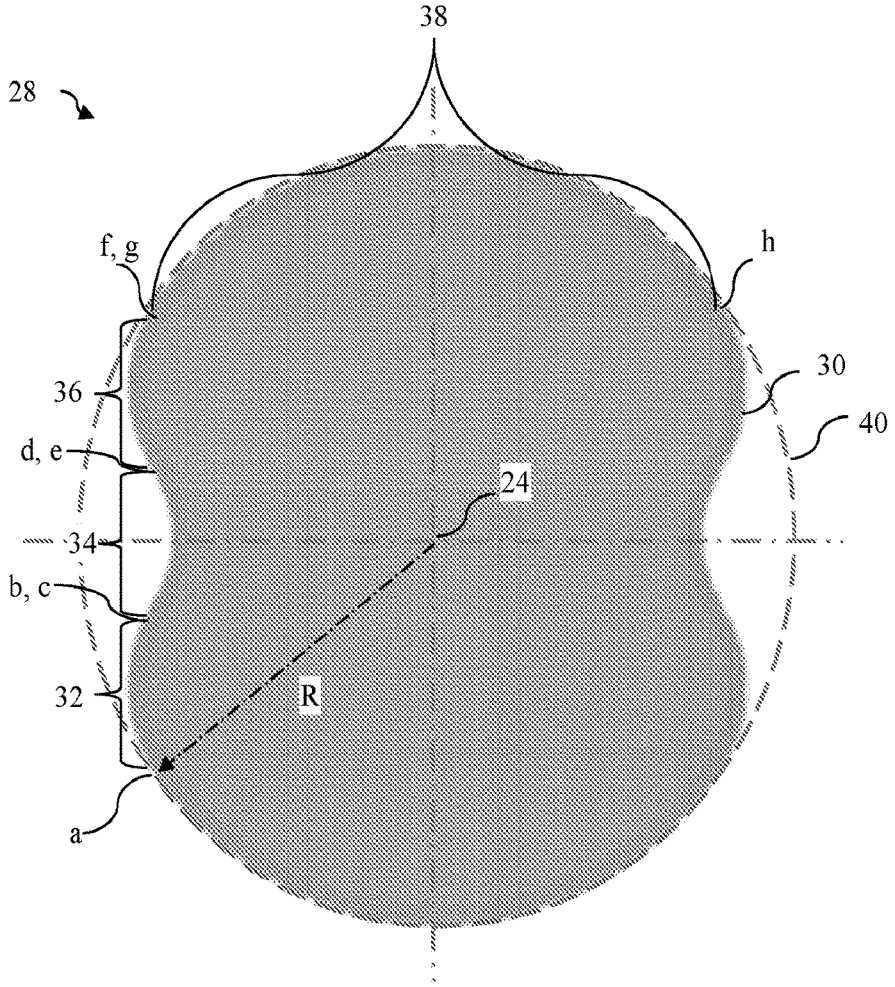
FIG. 3 is a schematic view of an example of a cross-sectional shape of a cutting element.

FIGS. 2 and 3 illustrate exemplary cross-sectional shapes of a cutting element usable for facilitating the retention of the cutting element in a cavity formed in the blade. When a cavity that is shaped for receiving the cutting element such as shown in these Figures is formed in the blade, the blade can be thicker around the opening in the edge of the blade than when the cavity is shaped for receiving a cutting element that has a circular cross-section. Accordingly, the cutting element such as shown in FIG. 2 or 3 may be mechanically retained in the cavity by the blade. Furthermore, the cutting element may not be excessively recessed below the edge of the blade so that the cutting element may still be sufficiently exposed to crush or shear rock.

In the example of FIG. 2, a section 28 of a cutting element 14 has a rotational symmetry of order three around its longitudinal axis 24. In the example of FIG. 3, the section 28 of the cutting element 14 has a rotational symmetry of order two around its longitudinal axis 24. In both Figures, the section 28 is taken perpendicularly to the longitudinal axis 24 of the cutting element 14. The section 28 has a contour line 30, which is described hereinafter.

The contour line 30 includes a first line portion 32 that has a first endpoint a and a second endpoint b, which is offset from the first endpoint a. The first endpoint a of the first line portion 32 is located at a predetermined radial distance R from the longitudinal axis 24, which may be selected to optimize the drilling performance of the earth-boring bit as known. The second endpoint b of the first line portion 32 is located at a distance from the longitudinal axis 24 that is shorter than R. At its first endpoint a, the first line portion 32 is tangent to a circle 40 centered on the longitudinal axis 24 and having a radius equal to R. The first line portion 32 has a variable or constant curvature, and the first line portion 32 is more curved than the circle 40. In other words, the curvature of the first line portion 32 has a sign that is constant, and a magnitude that is larger than the inverse of R. For example, the first line portion 32 may be a circular arc that has a radius smaller than R, or an elliptic arc that has a width and a height smaller than R.

The contour line 30 includes a second line portion 34 that has a first endpoint c and a second endpoint d, which is offset from the first endpoint c. The first endpoint c of the second portion 34 is co-located with the second endpoint b of the first line portion 32. All points of the second line portion 34 are located at distances from the longitudinal axis 24 that are shorter than R. As such, at least a portion of the area between the second line portion 34 and the circle 40 may be filled with blade material (not shown in FIGS. 2 and 3), and thus, the blade may be thicker. At its first endpoint c, the second line portion 34 is tangent to the first line portion 32. The second line portion 34 is smooth. For example, the second line portion 34 may be a circular arc, an elliptic arc, or a straight line. The second line portion 34 may be convex, such as shown in FIG. 2, or concave, such as shown in FIG. 3.

The contour line 30 includes a third line portion 36 that has a first endpoint e and a second endpoint f, which is offset from the first endpoint e. The first endpoint e of the third line portion 36 is co-located with the second endpoint d of the second line portion 34. The second endpoint f of the third line portion 36 is located at a distance R from the longitudinal axis 24. At its first endpoint e, the third line portion 36 is tangent to the second line portion 34. At its second endpoint f, the third line portion 36 is tangent to the circle 40. The third line portion 36 has a variable or constant curvature, and the third line portion 36 is more curved than the circle 40. For example, the third line portion 36 may be a circular arc that has a radius smaller than R, or an elliptic arc that has a width and a height smaller than R.

The contour line 30 includes a fourth line portion 38 that has a first endpoint g and a second endpoint h, which is offset from the first endpoint g. The first endpoint g of the fourth line portion 38 is co-located with the second endpoint f of the third line portion. The fourth line portion 38 is an arc of the circle 40.

The remainder of the contour line 30 is derived from the rotational symmetry of the cutting element 14.

A cavity is formed in a blade for receiving a cutting element 14 such as shown in FIG. 2 or 3. The cavity is shaped to receive a portion of a cutting element 14 such that the cutting element protrudes from the cavity through the first opening in the edge of the blade and through the second opening in the leading face of the blade. As such, the cutting edge and the cutting face of the cutting element 14 are exposed to rock.

A wall of the cavity includes a surface that is complementary of a portion of the lateral surface of the cutting element 14. For example, the wall of the cavity includes a surface that is complementary of the portion of the lateral surface of the cutting element 14 shaped like the second line portion 34. When the cutting element 14 is received in the cavity, this surface contacts the complementary portion of the lateral surface of the cutting element 14. Because the portion of the contour line 30 contacted by the cavity wall is not entirely circular, the cutting element 14 is prevented from rotating around the longitudinal axis 24 inside the cavity. In other words, the portion of the contour line 30 contacted by the cavity wall provides a keyseat for the cavity wall, and the cavity wall provides a key for the portion of the lateral surface of the cutting element 14 contacted by the cavity wall.

When a cutting element having a cross-sectional shape such as shown in FIG. 2 or 3 is received in a cavity 12 formed in a blade 10, the first line portion 32 is preferably adjacent to the wall 26 of the cavity 12 so that the cutting element 14 is mechanically retained in the cavity 12. Furthermore, the third line portion 36 and the fourth line portion 38 preferably protrude from the first opening of the cavity 12 so that a surface of the cutting element 14 is sufficiently exposed.

In alternative embodiments, the fourth line portion may be omitted.

Figure 4A:
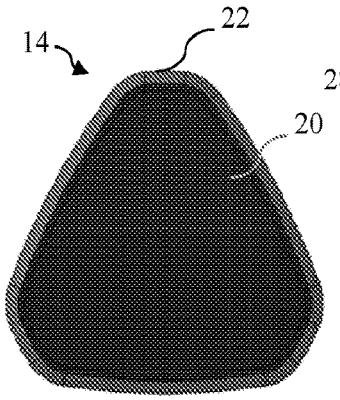
FIGS. 4A-4C are front, top, and perspective views of an example cutting element that has cross-sectional shapes of a type shown in FIG. 2.
Figure 4B:
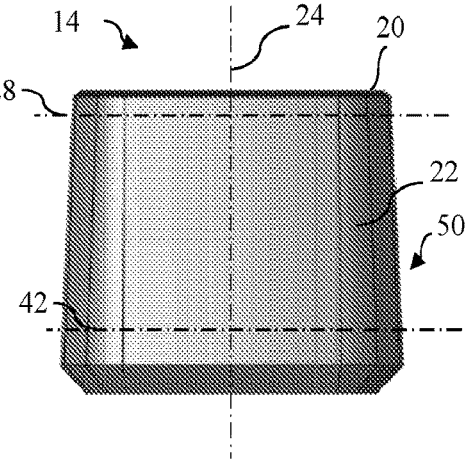
Figure 4C:
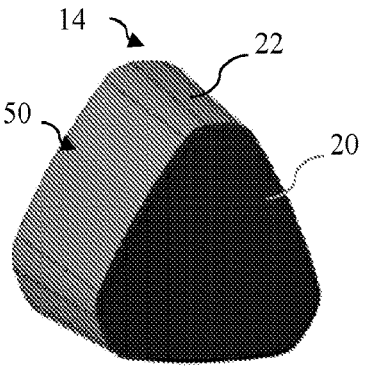

FIGS. 4A-6C illustrate cutting elements 14 that have cross-sectional shapes of a type disclosed in the description of FIG. 2 or 3, and at least one lateral surface 50 that is flared and characterized by line portions 32, 34, and 36. As shown in FIGS. 4A-6C, the lateral surface 50 is flared such that it points inwards in the direction toward the cutting face of the ultra-hard table 20. In other words, the closer to the cutting face of the ultra-hard table 20 the cross-section of the cutting elements 14 is, the cross sectional area of cutting element 14 becomes smaller. For example, the cutting elements 14 may have a first cross-section 28 and a second cross-section 42 that is offset from, and parallel to, the first section 28 and farther from the cutting face of ultra-hard table 20 of the cutting elements 14. The first cross-section 28 may have a first contour line, and the second section 42 has a second contour line. All points of the second contour line are located at distances from the longitudinal axis 24 that are longer than or equal to a minimum eccentricity of the second contour line, and some points of the first contour line are located at distances from the longitudinal axis 24 that are shorter than the minimum eccentricity of the second contour line. A particular example is when the second contour line is a homogeneous dilatation of the first contour line, such as shown in FIGS. 4A-4C. For example, a flare angle may be determined experimentally to ensure sufficient mechanical retention and sufficient strength of the cutting element while drilling. The flare angle may be on the order of ten degrees. Another particular example is when the cutting elements 14 have a lateral surface 50 that is flared as well as a lateral surface 51 that is cylindrical, such as shown in FIGS. 5A-5C.

Figure 17A:
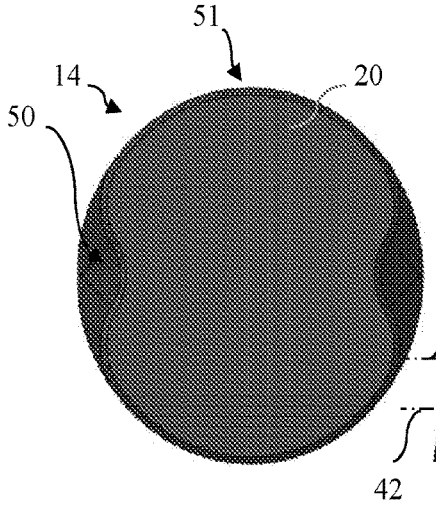
FIGS. 17A-17C are front, top, and perspective views of an example cutting element without a substrate, the example cutting element having cross-sectional shapes of a type shown in FIG. 2 or 3.
Figure 17B:
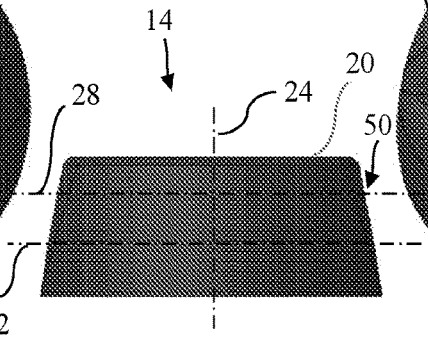
Figure 17C:
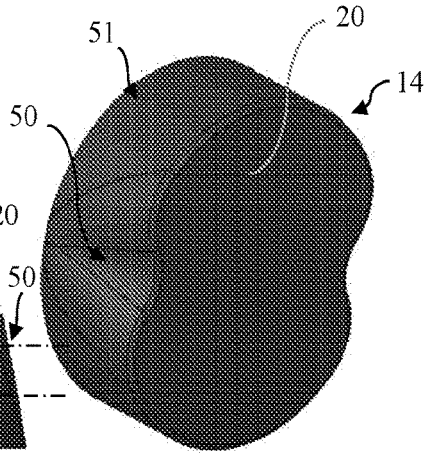

In the embodiments shown in FIGS. 4A-6C, the cutting element 14 includes a substrate 22 and an ultra-hard table 20, and the lateral surface 50 that is flared is at least partially formed on the substrate 22. However, when the cutting element 14 is mechanically attached, the substrate 22, which is used for brazing the cutting element 14 to the blade 10, may not be needed. Thus, in other embodiments, the size of the substrate 22 may be reduced, or the substrate 22 may even be omitted and the cutting element 14 may consist of an ultra-hard table 20 as illustrated in FIGS. 17A-17C. Accordingly, the cutting element 14 may consist of a table of sintered polycrystalline diamond where the transition metal used as the sintering catalyst, usually cobalt or nickel, is partially or essentially entirely leached or otherwise removed from the pores of the polycrystalline diamond matrix that are connected to the table surface. Nevertheless, a significant amount of transition metal may remain in the unconnected pores, and a residual amount of transition metal may remain in the connected pores. Such a cutting element 14 may be more heat resistant and durable than a cutting element 14 including a larger proportion of transition metal in the ultra-hard table 20.

FIGS. 7A-7E illustrate a method for mounting a cutting element 14 of a type disclosed in the description of FIGS. 4A-6C. In certain embodiments related to the methods shown in FIGS. 7A-7E, cutting element 14 has a cross sectional shape at section 28 as shown in FIG. 3. The cavity 12 is longer than the cutting element 14. The back of the opening in the edge 18 of the blade is larger than its front so that the cutting element 14 can be introduced into the cavity 12 through the back of the opening in the edge 18 of the blade. The cutting element 14 is then advanced toward the leading face 16 of the blade until it engages a portion of the wall 26 of the cavity 12 that is complementary to the shape of a portion of the lateral surfaces 50 and 51. Preferably, after moving the cutting element 14 in the forward direction, a substantial portion of the lateral surface 50 that is flared is contacted by the wall 26 of the cavity. Further and as described above, surfaces of cutting element 14 engage within cavity 12 by the contact of surfaces characterized by line portions 30, 32, 34, and/or 36 (as shown in FIG. 3) with the complementary surfaces in cavity 12. Additionally, while moving cutting element 14 within cavity 12 toward leading face 16, first cross-section 28 is advanced through cavity 12 and cutting element 14 is then constrained from additional forward movement within cavity 12 upon the larger cross sectional area of cutting element 14 at second cross-section 42 engaging or interfering with wall 26 of cavity 12.

A retainer 44 is then introduced through the back of the opening in the edge 18 of the blade. The retainer 44 comprises a shim and in a fastener. For example, the shim may be made from several types of material such as steel or metal carbide. When positioned, the shim abuts the cutting element 14 and a back surface 27 of the wall 26. As such, the cutting compression forces applied in the direction of the longitudinal axis 24 are substantially transmitted to the back surface 27 of the wall 26. The shim is then releasably attached to the blade using the fastener, such as by using a screw, an adhesive, or brazing. The fastener prevents the shim from falling off through the first opening in the edge 18 of the blade 10; however, the fastener is not required to resist the cutting compression forces applied in the direction of the longitudinal axis 24.

Because the shape of the lateral surface 50 is not cylindrical and due to the engagement of complementary surfaces among the cutting element 14 and cavity 12 described above, the cutting element 14 is prevented from rotating under cutting forces applied the cutting element 14 by the rock, such fixation as would be otherwise be provided by brazing in the prior art. In other words, a substantial portion of the lateral surface 50 provides a keyseat for the cavity wall, and the cavity wall provides a key for the portion of the lateral portion 50 of the cutting element 14 contacted by the cavity wall.

The wall 26 or a portion of the wall 26 of the cavity 12 is also flared such that it points inward in the direction toward the leading face 16 of the blade 10. The wall 26 of the cavity 12 is shaped to engage the lateral surfaces 50 and/or 51 of the cutting element 14 (shown in FIGS. 4A-6C). As such, the blade 10 can be thicker around the second opening in the leading face 16 of the blade than when the cavity is formed for receiving a cutting element having a straight cross-section. Thus, the cutting element 14 may be mechanically retained in the cavity 12 by the blade 10 and may not fall off through from the second opening in the leading face 16 of the blade 10.

The cutting element 14 may or may not include a substrate 22 attached to an ultra-hard table 20, and may thus consist of an ultra-hard table 20 in some embodiments.

Figure 7A:
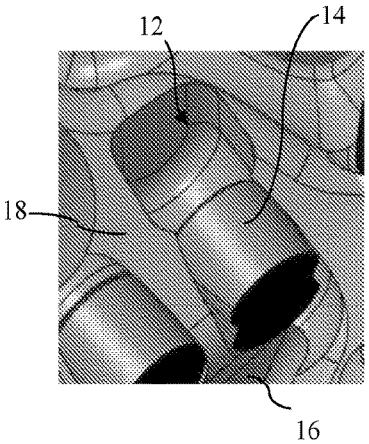
FIGS. 7A-7E are perspective views of a portion of an earth-boring bit that illustrate an example method for mounting cutting elements such as shown in FIGS. 4A-6C.
Figure 7B:
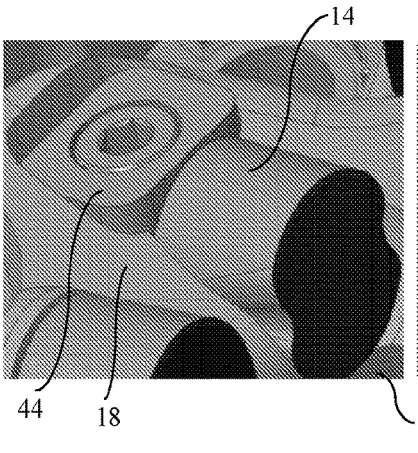
Figure 7C:
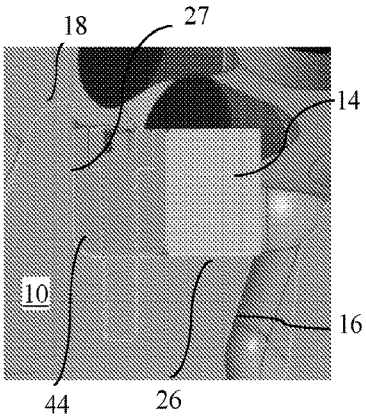
Figure 7D:
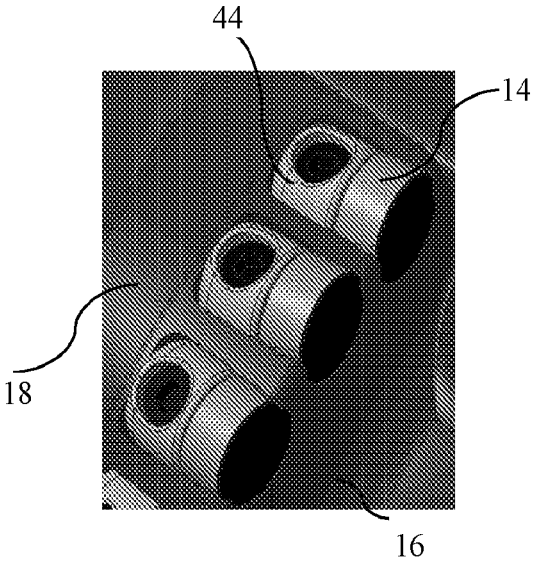
Figure 7E:
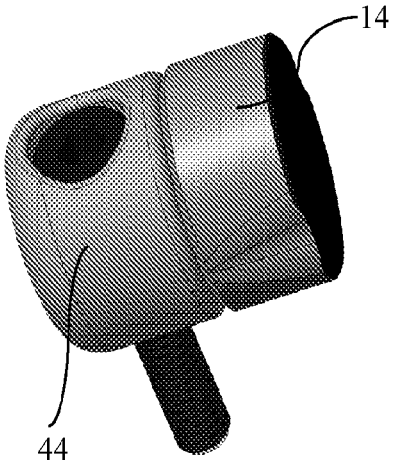

FIGS. 7A-7C differ from FIGS. 7D-7E at least by the shape of the retainer 44. In FIGS. 7A-7C, the retainer 44 has a cross-sectional shape of a rectangle combined with a semi-circle. In FIGS. 7D-7E, the retainer 44 has a cross-sectional shape of a circle.

Figure 8:
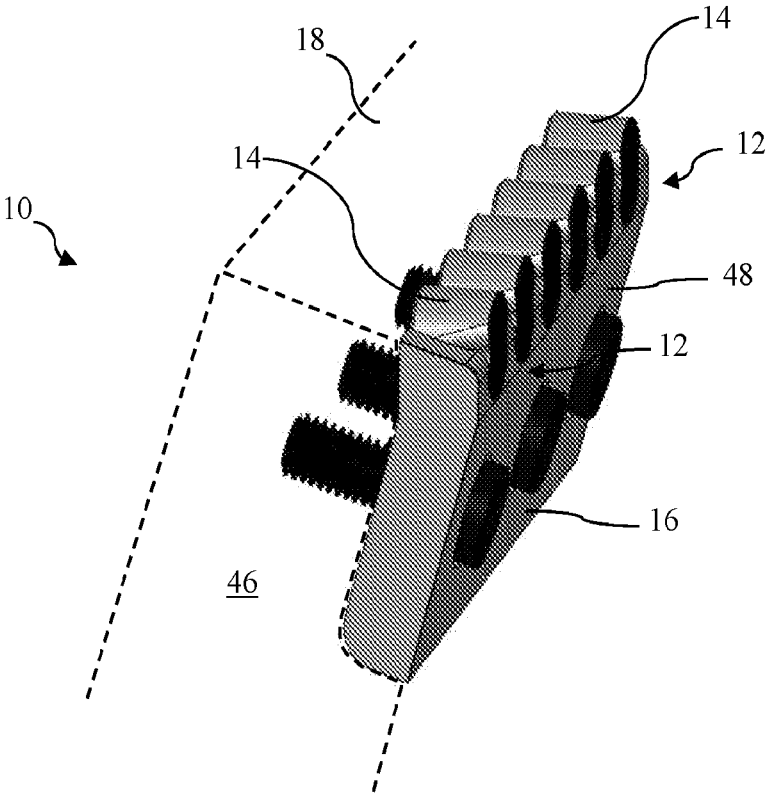
FIG. 8 is a perspective view of a portion of an earth-boring bit that illustrates another example method for mounting cutting elements such as shown in FIGS. 4A-6C.

FIG. 8 illustrates an alternative method for mounting a cutting element 14 of a type disclosed in the description of FIGS. 4A-6C. The blade 10 includes a fixed portion 46, which may be integral to the bit body, and a plate 48, which may be releasably attached to the fixed portion 46. Before the plate 48 is attached to the fixed portion 46, the cutting element 14 is introduced into the cavities 12 that is formed into the plate 48 from a back (i.e., opposite the leading face 16) opening of the cavity. The cutting element 14 is then advanced until it engages the wall of the cavity 12. The plate 48 is then attached to the fixed portion 46, such as by using a screw. Other means for attaching the plate 48 to the fixed portion 46 may include a dovetail joint, an adhesive, or other known means capable of attaching the plate 48 to the fixed portion 46 during drilling. The fixed portion 46 of the blade 10 abuts the cutting element 14. After attachment of the plate 48, a central surface of the plate 48 forms at least a portion of the leading face 16 and a lateral surface of the plate 48 forms at least a portion of the edge 18 of the blade 10. The cutting element 14 may or may not include a substrate 22 attached to an ultra-hard table 20, and may thus consist of an ultra-hard table 20 in some embodiments.

Figure 9A:
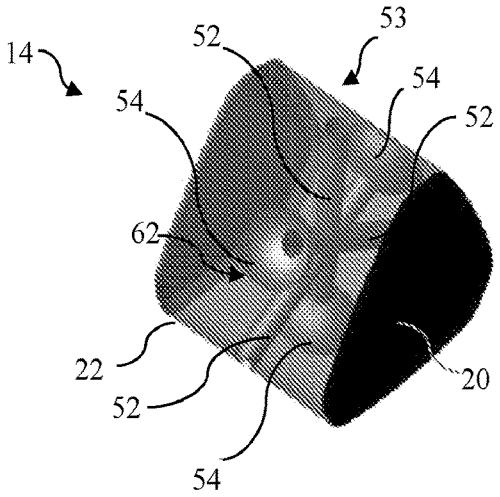
FIGS. 9A-9B are perspective, transparent views of an example cutting element that has a through-hole formed in the substrate.
Figure 9B:
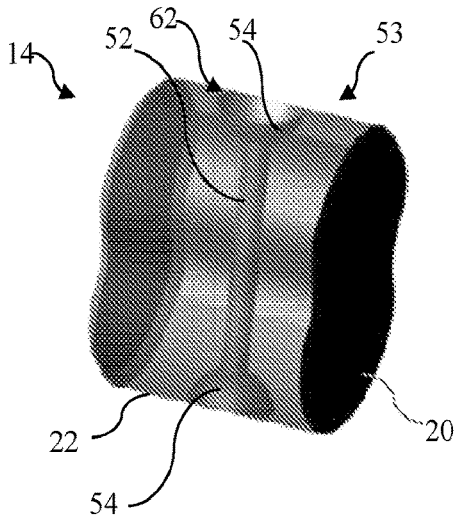

FIGS. 9A-9B illustrate cutting elements 14 that have cross-sectional shapes of a type disclosed in the description of FIG. 2 or 3, and a lateral surface 53 that neither flares out nor contracts. In contrast with the cutting elements 14 illustrated in FIGS. 4A-6C, which have a lateral surface that is flared, the cutting elements 14 illustrated in FIGS. 9A-9B could slide inside the cavity 12, and fall off the earth-boring bit through the opening in the leading face 16 of the blade 10. In order to avoid the cutting elements 14 from falling off, the lateral surface 53 of the cutting elements 14 include one or more concave depressions 54, wherein each of the concave depressions 54 is surrounded by a corner 62 formed at the interface between the concave depression 54 and the remainder of the lateral surface 53. The number of depressions 54 preferably depends on the order of symmetry of the cutting elements 14, for example, three depressions 54 are shown in FIG. 9A and two depressions 54 are shown in FIG. 9B. Furthermore, one or more through-holes 52 are formed in the substrate 22 of the cutting element 14 such that one through-hole 52 leads to each of the concave depression 54. The through-holes 52 are sized for introducing an elongated tool in them. The elongated tool is used as described hereinafter.

Figure 10A:
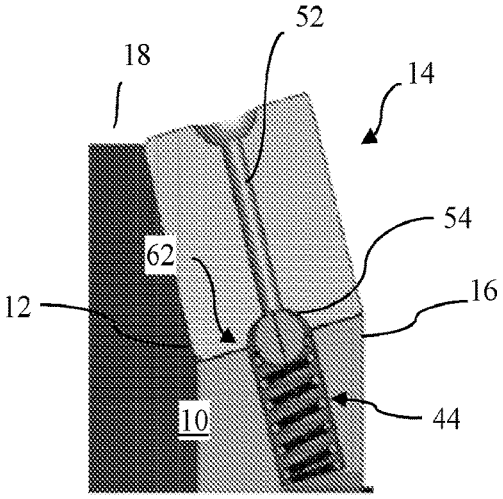
FIGS. 10A-10B are sectional views of a portion of an earth-boring bit that illustrate an example method for mounting cutting elements such as shown in FIGS. 9A-9B.
Figure 10B:
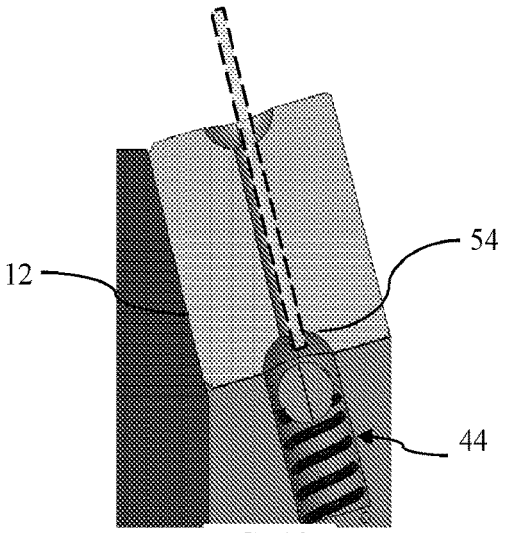
Figure 19A:
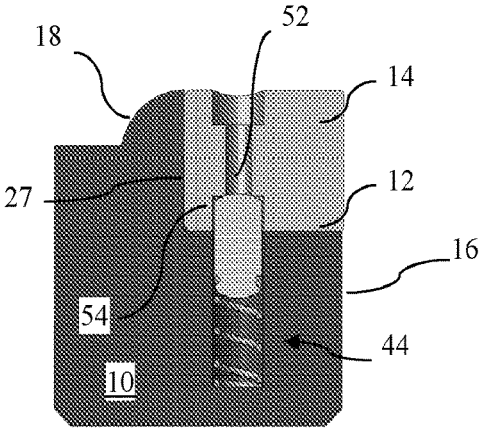
FIGS. 19A-19B are sectional views of a portion of an earth-boring bit that illustrate an example method for mounting cutting elements such as shown in FIG. 18.
Figure 19B:
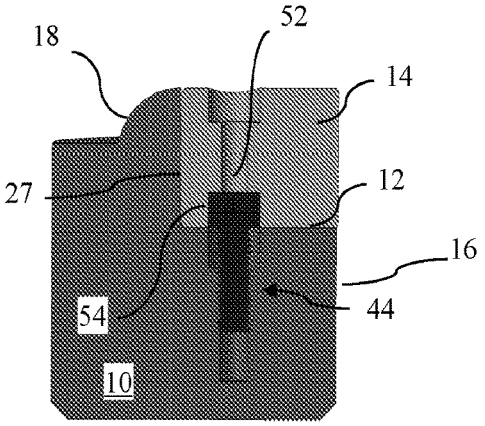

FIGS. 10A and 10B illustrate a method of retaining cutting elements 14 of a type illustrated in FIGS. 9A-9B inside cavities 12 in the blade 10. A retainer 44 is positioned and can remain in the cavity 12. For example, the retainer 44 illustrated in FIGS. 10A and 10B comprises a ball and a spring, wherein the spring is disposed between the wall 26 of the cavity 12 and the ball. In other embodiments, the retainer 44 can comprise a peg and a spring, wherein the spring is disposed between the wall 26 of the cavity 12 and the peg, such as illustrated in FIG. 19A. In other embodiments, the retainer 44 can comprise a threaded setscrew engaged with threads formed on the wall 26 of the cavity 12, such as illustrated in FIG. 19B. The retainer 44 is movable between a first position, as shown in FIG. 10A, and a second position, as shown in FIG. 10B. In the first position, the retainer 44 is engaging the concave depression 54. The corner 62 is sufficiently sharp so that the retainer 44 essentially remains in the first position when the cutting element 14 applies a side force to the retainer 44. The positioning of the retainer 44 in the first position, combined with the cross-sectional shapes of a type disclosed in the description of FIG. 2 or 3, completely retains the cutting element 14 in the blade 10 mechanically. In the second position, the retainer 44 is offset from the lateral surface 53 of the substrate 22 so that the cutting element 14 can be released from the blade 10. For example, the retainer 44 may be pushed from the first position into the second position with an elongated tool (shown in ghost line in FIG. 10B), that has been introduced in the through-hole 52. Alternatively, the retainer 44 may be unscrewed with an elongated tool that has been introduced in the through-hole 52, until the retainer 44 reaches a second position, wherein the retainer 44 is offset from the lateral surface 53 of the cutting element 14 so that the cutting element 14 can be released from the blade 10.

The rotational symmetry of the cutting elements 14 of a type illustrated in FIGS. 4A-6C or FIGS. 9A-9B may be utilized to expose a second, sharp cutting surface of the cutting elements 14 once a first cutting surface of the cutting elements 14 is worn. Accordingly, a method of using these cutting elements may involve the steps of using an earth-boring bit whereby the first surface of the cutting element 14 wears, releasing the cutting element 14 from the blade 10, turning the cutting element 14 around the longitudinal axis 24, and retaining the cutting element 14 in the blade 10 in a position such that a second surface of the cutting element 14 that is not worn is exposed.

Figure 11A:
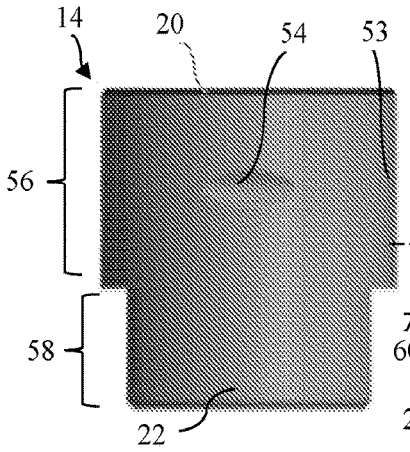
FIGS. 11A-11C are bottom, side, and perspective views of an example cutting element that has a funneled lateral surface.
Figure 11B:
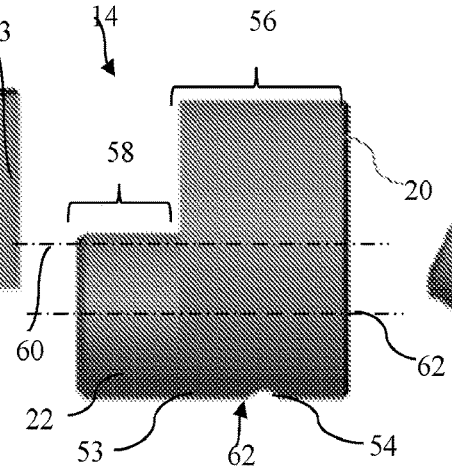
Figure 11C:
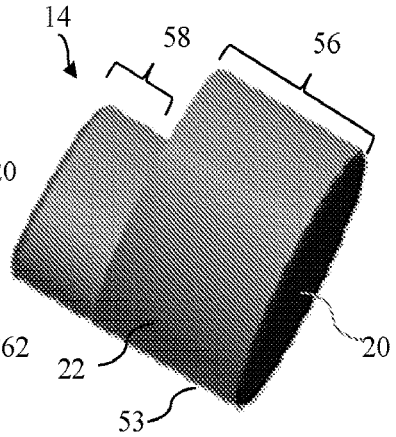

FIGS. 11A-11C illustrate a cutting element 14 that has a lateral surface 55 that is shaped like a funnel, so that the blade can be thicker behind the opening in the edge 18 of the blade 10 than when the cavity is formed for receiving a cutting element having a cylindrical lateral surface. Accordingly, the cutting element may be mechanically retained in the cavity by the blade. The cutting element 14 may or may not include a substrate 22 attached to an ultra-hard table 20, and may thus consist of an ultra-hard table 20 in some embodiments.

Figure 12:
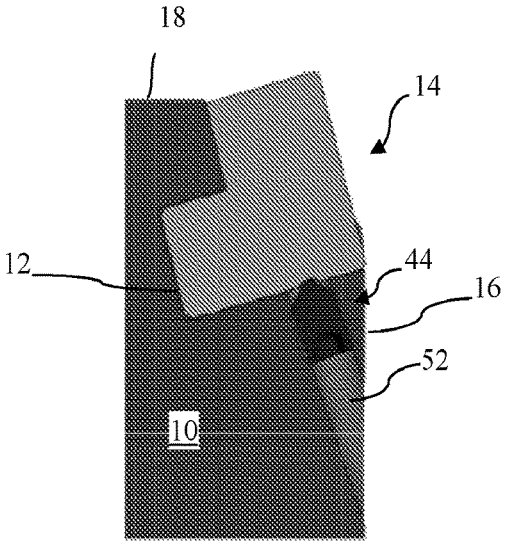
FIG. 12 is a perspective view of a portion of an earth-boring bit that illustrates an example method for mounting cutting elements such as shown in FIGS. 11A-11C.

The cutting element 14 includes a first longitudinal portion 56 and a second longitudinal portion 58. For example, the first longitudinal portion 56 and/or the second longitudinal portion 58 may be cylindrical, such as shown. The first longitudinal portion 56 may be adjacent to the second longitudinal portion 58, such as shown, or a transitional portion (not shown) may be provided between the first longitudinal portion 56 and the second longitudinal portion 58. The first longitudinal portion 56 has a first central axis 60, and the second longitudinal portion 58 has a second central axis 60 that is parallel to, and offset from, the first central axis 60. As shown in FIG. 12, the first longitudinal portion of the cutting element protrudes from the cavity 12 through the opening in the edge 18 of the blade 10.

FIG. 12 illustrates the cutting element 14 shown in FIGS. 11A-11C after it is positioned and retained in a cavity 12 of the blade 10. A first section of the first longitudinal portion 56 that is perpendicular to the first central axis 60 has a first maximum width. The first maximum width is such that the first longitudinal portion 56 of the cutting element 14 protrudes from the cavity 12 through the first opening in the edge 18 of the blade 10 and provide sufficient exposure for the cutting element 14 to crush or shear rock. A second section of the second longitudinal portion 58 that is perpendicular to the second central axis 60 has a second maximum width that is smaller than the first maximum width. The first maximum width and the offset are such that the second longitudinal portion 58 of the cutting element is entirely recessed into the blade 10, thus increasing the thickness of the blade 10 behind the first opening in the edge 18 of the blade 10. Furthermore, the direction of the offset of the second central axis 60 relative to the first central axis 60, illustrated downward in FIG. 12, is such that the blade 10 behind the first opening in the edge 18 of the blade 10 is thicker than with other directions of the offset, for example, an upward direction.

FIG. 12 also illustrates a method of retaining cutting elements 14 of a type illustrated in FIGS. 11A-11C inside cavities 12 in the blade 10. A through-hole 52 is formed in the blade 10 instead of in the substrate 22 as shown in FIG. 10, and leads to a retainer 44. In the example of FIG. 12, the retainer 44 comprises a threaded setscrew engaged with threads formed on the wall 26 of the cavity 12.

As shown in FIG. 12, the retainer 44 is in a first position wherein the retainer 44 engages a concave depression 54 so that the cutting element 14 is mechanically retained in the blade 10. Similarly to FIGS. 9A and 9B, a concave depression 54 is formed in the lateral surface of the cutting element 12 and is surrounded by a corner 62. In order to release the cutting element 14 from the blade 10, the retainer 44 may be unscrewed with an elongated tool that has been introduced in the through-hole 52, until the retainer 44 reaches a second position, wherein the retainer 44 is offset from the lateral surface 53 of the cutting element 14 so that the cutting element 14 can be released from the blade 10.

In other embodiments, cutting elements 14 of a type illustrated in FIGS. 11A-11C may alternatively be retained inside cavities 12 in the blade 10 using the retainer 44 illustrated in FIG. 10. In these embodiments, the substrate of the cutting elements 14 would include a through-hole leading to the concave depression 54, and the through-hole 52 formed in the blade 10 would be omitted.

While FIG. 12 illustrates a method of retaining cutting elements 14 of a type illustrated in FIGS. 11A-11C inside cavities 12 in the blade 10, it should be appreciated that a similar method may be used to retain cutting elements of a type described in FIGS. 9A and 9B. In such embodiments, the through-hole 52 formed in the substrate of the cuttings elements 14, as illustrated in FIGS. 9A and 9B, would again be omitted.

Figure 13A:
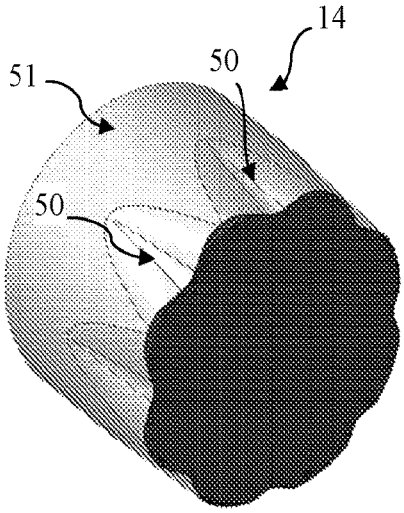
FIGS. 13A-13C are perspective, top, and front views of an example cutting element that has cross-sectional shapes of a type shown in FIG. 2 or 3 with a higher order of symmetry.
Figure 13B:
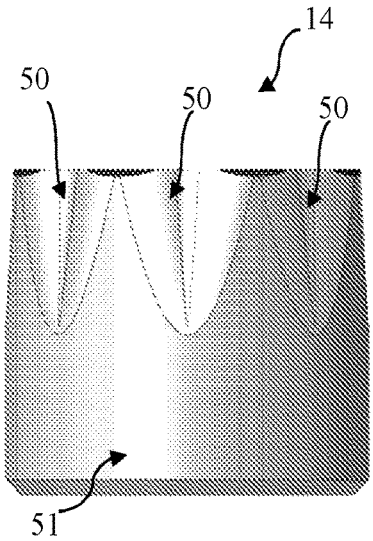
Figure 13C:
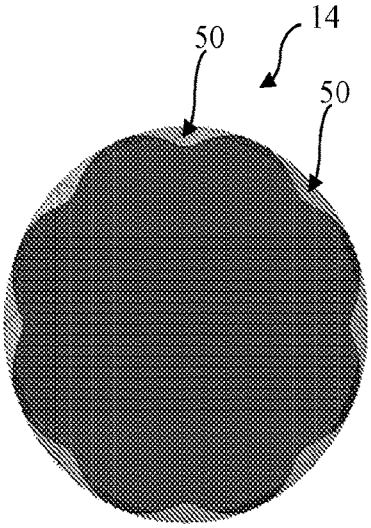
Figure 13D:
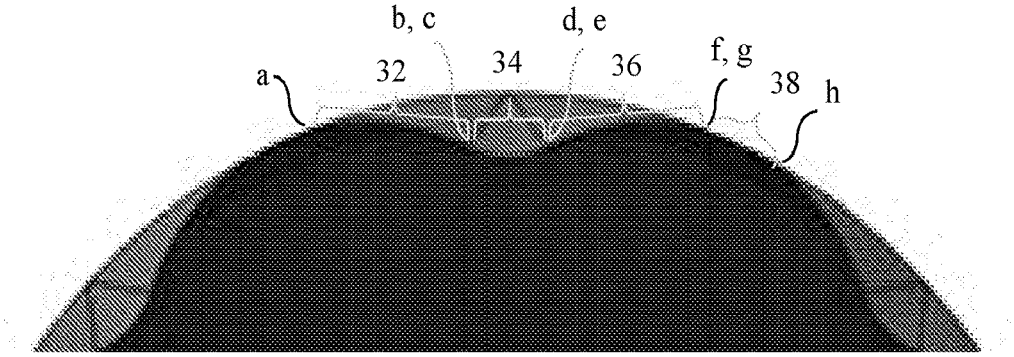
FIG. 13D is a front view of a portion of the cutting element shown in FIGS. 13A-13C.

FIGS. 13A-13C illustrate a cutting element 14 that has a rotational symmetry of order eight. FIG. 13D illustrates a portion of the cutting element 14 shown in FIGS. 13-13C. As best seen in FIG. 13D, the cutting element 14 has a section that is perpendicular to its longitudinal axis having a contour line that includes a first line portion 32, a second line portion 34, a third line portion 36, and a fourth line portion 34, as previously described in FIG. 3. The remainder of the contour line 30 is derived from the rotational symmetry of the cutting element 14. As best seen in FIG. 13A-13C, the cutting elements 14 has a plurality (eight in this embodiment) of lateral surfaces 50 that are flared as well as a lateral surface 51 that is cylindrical, in a way similar to the lateral surfaces previously described in FIGS. 5A-5C. The cutting element 14 may or may not include a substrate 22 attached to an ultra-hard table 20, and may thus consist of an ultra-hard table 20 in some embodiments.

The cutting element 14 can be received in a cavity is formed in a blade. The wall or a portion of the wall of the cavity is also flared such that it has a plurality of surfaces (e.g., eight or six surfaces in this embodiment) that point inward in the direction toward the leading face of the blade. The wall of the cavity is shaped to engage the lateral surfaces 50 and/or 51 of the cutting element 14. As such, the blade can have a plurality of regions that are thicker around the opening in the leading face of the blade than when the cavity is formed for receiving a cutting element having a straight cross-section. The regions that are thicker around the opening in the leading face 16 of the blade 10 engage a corresponding number of lateral surfaces 50 of the cutting element 14. Thus, the cutting element 14 may be mechanically retained in the cavity by the blade.

Figure 5A:
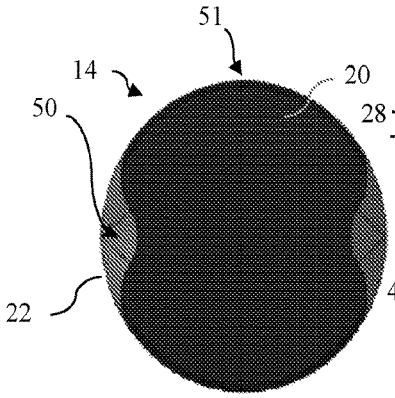
FIGS. 5A-5C are front, top, and perspective views of an example cutting element that has cross-sectional shapes of a type shown in FIG. 3.
Figure 5B:
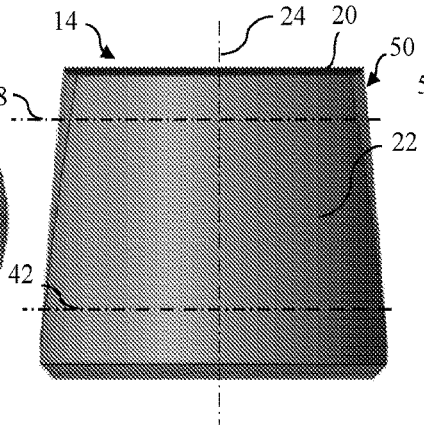
Figure 5C:
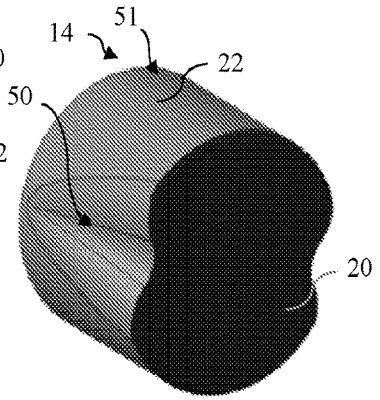
Figure 6A:
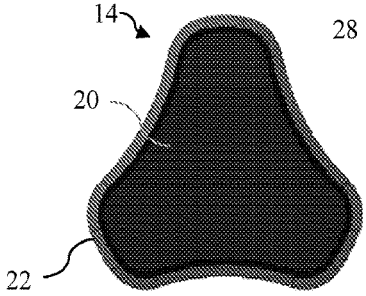
FIGS. 6A-6C are front, top, and perspective views of an example cutting element that has cross-sectional shapes of a type shown in FIG. 2.
Figure 6B:
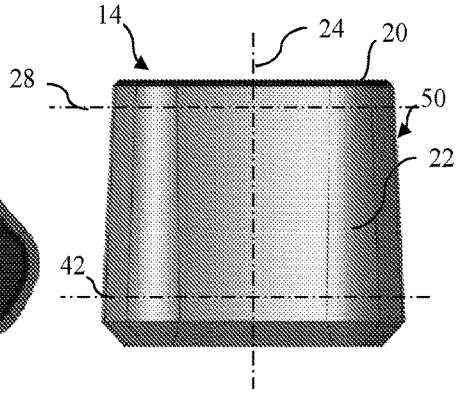
Figure 6C:
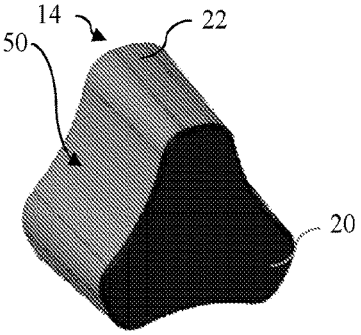

While the embodiment of FIGS. 13A-13C illustrates a cutting element 14 that has a rotational symmetry of order eight, in other embodiments, the cutting element 14 may have another order of symmetry, such as two as shown in FIGS. 5A-5C, or more.

Figure 14A:
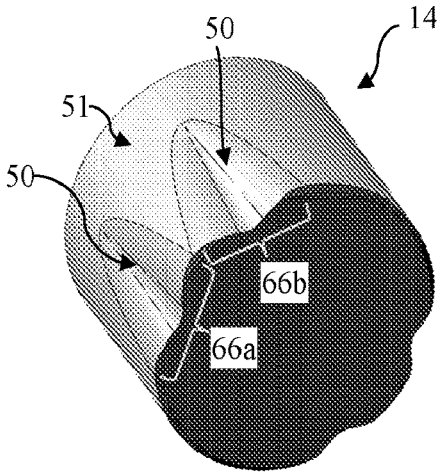
FIGS. 14A-14B are perspective and front views of an example cutting element that has cross-sectional shapes of a type shown in FIG. 2 or 3.
Figure 14B:
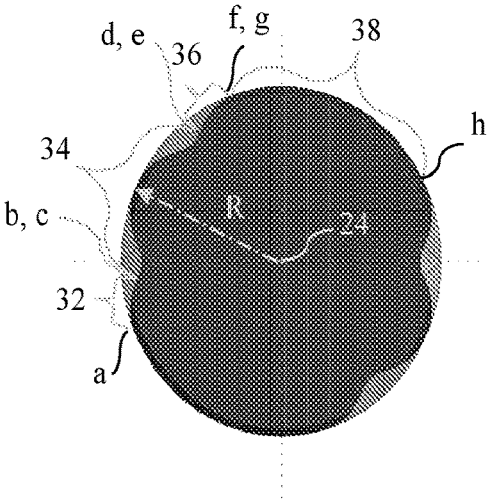

FIGS. 14A and 14B illustrate a cutting element 14 that has a rotational symmetry of order two. As best seen in FIG. 14B, the cutting element 14 has a section that is perpendicular to its longitudinal axis having a contour line that includes a first line portion 32, a second line portion 34, a third line portion 36, and a fourth line portion 34, similar to the line portions previously described in FIG. 3. In this embodiment, the second line portion 34 has two intervals 66*a* and 66*b* which have a rotational symmetry of 22.5 degrees in this example. Thus, the cutting elements 14 has four lateral surfaces 50 that are flared as well as a lateral surface 51 that is cylindrical. In addition, some points of the second line portion 34 are located at distances from the longitudinal axis 24 that are equal to R. Furthermore, the second line portion 34 is only partially concave, because it has a middle portion that is convex, and to end portions that are concave. For example, the middle and end portions of the second line portion 34 may be circular arcs, elliptic arcs, or combinations of circular and elliptic arcs. The cutting element 14 may or may not include a substrate 22 attached to an ultra-hard table 20, and may thus consist of an ultra-hard table 20 in some embodiments.

Figure 15A:
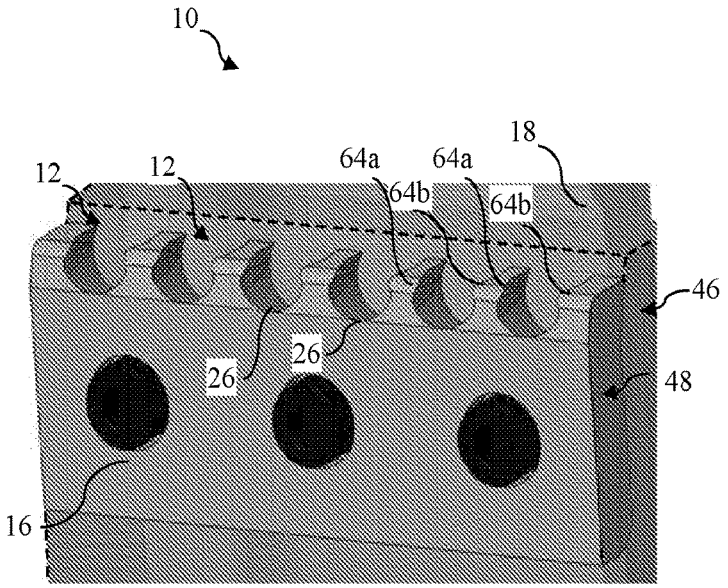
FIGS. 15A-15C are perspective views of a portion of an earth-boring bit that illustrates an example method for mounting cutting elements such as shown in FIGS. 13A-14B.
Figure 15B:
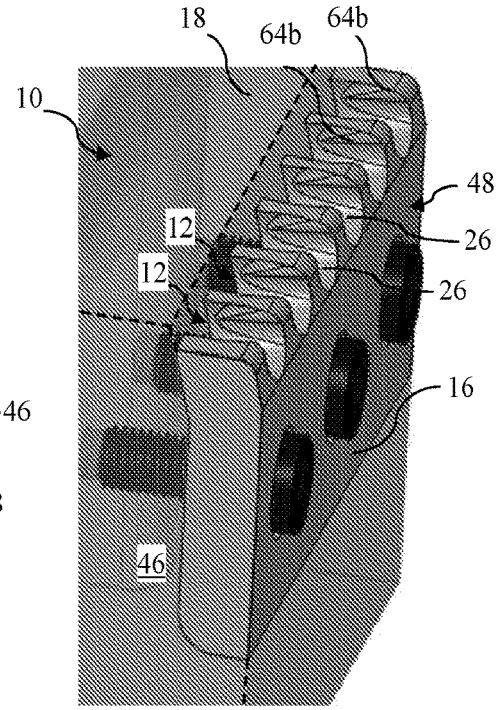
Figure 15C:
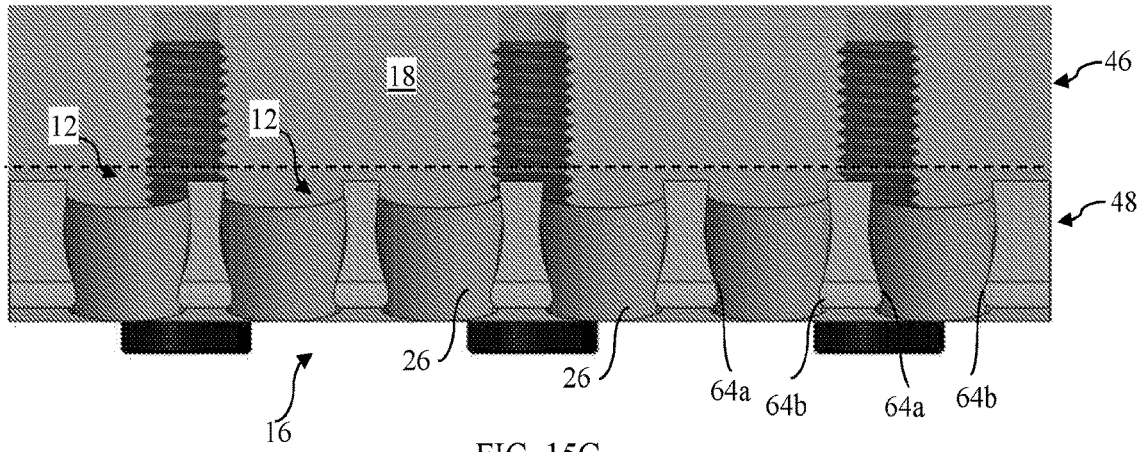

The cutting element 14 shown in FIGS. 14A-14B can be mounted, for example, in the blade 10 shown in FIGS. 15A-15C. The blade 10 shown in FIGS. 15A-15C is similar to the blade 10 previously described in FIG. 8, and includes a plate 48 and a fixed portion 46. The wall 26 or a portion of the wall 26 of the cavity 12 is also flared such that it has two surfaces 64*a* and 64*b* that point inward in the direction toward the leading face 16 of the blade 10. The two surfaces 64*a* and 64*b* engage only two of the four lateral surfaces 50 of the cutting element 14 such that the cutting element 14 can be mechanically retained in the cavity 12. In other words, each of the two surfaces 64*a* and 64*b* provides a key for one of the lateral surfaces 50 of the cutting element 14, and each of the lateral surfaces 50 provides a keyseat for the cavity wall.

Figure 16A:
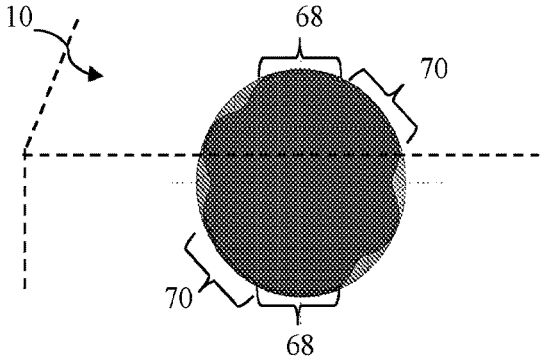
FIGS. 16A-16B are front views of a portion of an earth-boring bit that illustrates a method of using cutting elements such as shown in FIGS. 13A-13D.
Figure 16B:
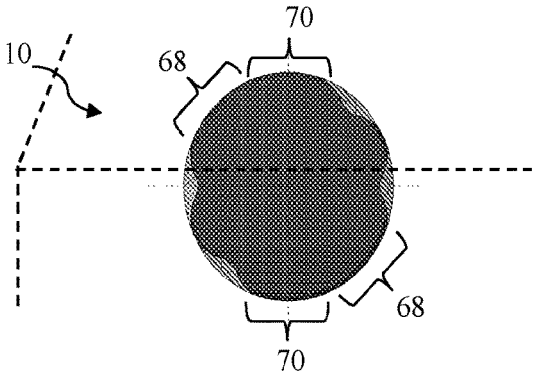

The rotational symmetry of the cutting elements 14 of a type illustrated in FIGS. 14A-14B cooperates with the rotational symmetry of the second line portion 34 to expose any of the two cutting surfaces 68 when the cutting elements 14 is mounted in the blade 10 as illustrated in FIG. 16A, and any of the two cutting surfaces 70 when the cutting elements 14 is mounted in the blade 10 as illustrated in FIG. 16B. As such, the cutting elements 14 has four positions that expose a different cutting surface.

While the embodiment of FIGS. 14A-14B illustrates a cutting element 14 that has a section having a contour line in which the second line portion 34 has two intervals 66*a* and 66*b* which have a rotational symmetry of 22.5 degrees, in other embodiments, the second line portion 34 may have more than two intervals that have a rotational symmetry. Furthermore, the rotational symmetry may be of an angle that differs from 22.5 degrees.

While the embodiment of FIGS. 15A-15C illustrates a method of mounting a cutting element of a type illustrated in FIGS. 14A-14B in a blade 10 that includes a fixed portion 46 and a plate 48 that is releasably attached to the fixed portion, in other embodiments, a cutting element of a type illustrated in FIGS. 14A-14B may alternatively be mounted in a blade in a way illustrated in FIGS. 7A-7E, that is, using a releasable retainer received through an opening in the edge 18 of the blade 10 after the cutting element 14 is engaged with the wall 26 of the cavity 12.

Figure 18:
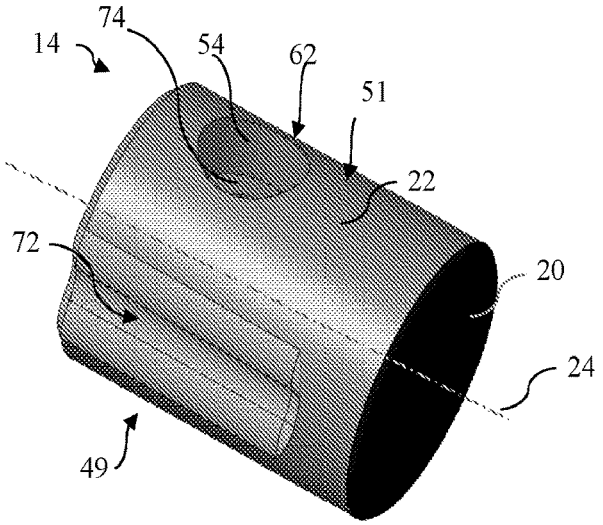
FIG. 18 is a perspective view of an example cutting element that has cross-sectional shapes of a type shown in FIG. 2 or 3 contained only in the substrate.
Figure 21:
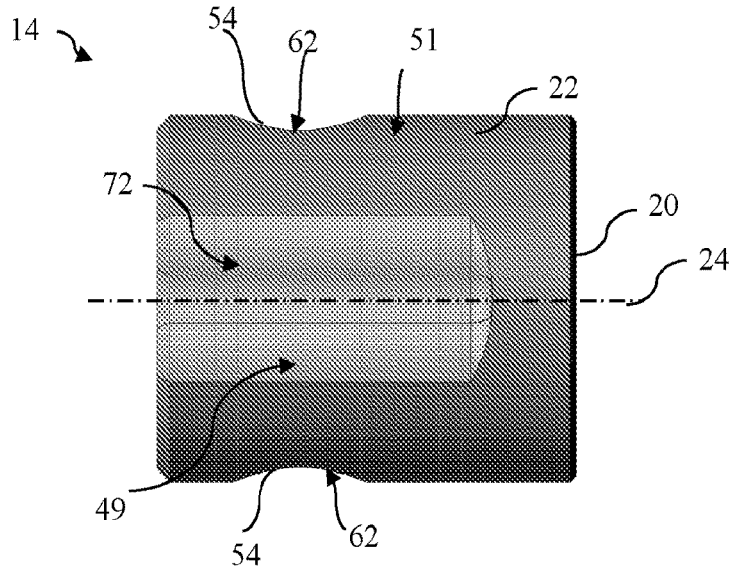
FIG. 21 is a perspective view of another example cutting element that has cross-sectional shapes of a type shown in FIG. 2 or 3 contained only in the substrate.

FIGS. 18 and 21 illustrate cutting elements 14 that have a rotational symmetry of order two. The cutting elements 14 have cross-sectional shapes of a type disclosed in the description of FIG. 3. The cutting elements 14 have at least one lateral surface 49 that is contained only in the substrate 22 and does not reach the ultra-hard table 20, and a lateral surface 51 that is cylindrical. Thus, the cutting elements 14 shown in FIGS. 18 and 21 are such that at least the cutting face of the ultra-hard table 20, and optionally an entirety of the ultra-hard table 20, has a circular perimeter. However, the cutting face of the ultra-hard table 20, and optionally an entirety of the ultra-hard table 20 may have a non-circular perimeter, which may not be dictated by the shape of the lateral surface 49. The lateral surface 49 has a longitudinal portion 72 that is parallel to a longitudinal axis 24 of the cutting element 14; however, the lateral surface 49 can alternatively be flared such that it points inwards in the direction away from the cutting face of the ultra-hard table 20. The lateral surface 49 provides a keyseat for the wall of the cavity 12.

In other embodiments, a cutting elements similar to the cutting element shown in FIGS. 18 and 21 may not have a rotational symmetry of order 2 or more. For example, the lateral surfaces 49, which are illustrated in FIGS. 18 and 21 at 180 deg. apart may instead be symmetrically opposed at an angle of less than 180 deg. apart (e.g., 120 deg. apart). In such embodiments, it may not be possible to turn the cutting element around the longitudinal axis in a position such that a surface of the cutting element that is not worn is exposed. However, the blade can be thicker around the opening in the edge of the blade than when the cavity is shaped for receiving a cutting element that his cylindrical.

Like the cutting elements 14 illustrated in FIGS. 9A-9B, the cutting elements 14 illustrated in FIGS. 18 and 21 could fall off the earth-boring bit through the opening in the leading face 16 of the blade 10. In order to avoid the cutting elements 14 from falling off, the cutting elements 14 shown in FIGS. 18 and 21 include one or more depressions 54, wherein each of the depressions 54 is surrounded by a corner 62 formed at the interface between the depression 54 and the remainder of the lateral surface 49 or 50. Furthermore, a through-hole 52 is formed in the substrate 22 of the cutting element 14 such that the through-hole 52 joins the depressions 54. In FIG. 18, a width of the through-hole 52 is smaller than a width of the corners 62 so that each depression 54 includes a shoulder 74. In FIG. 21, the width of the through-hole 52 is equal to the width of the corner 62 so that the depressions 54 extend the through-hole 52.

FIGS. 19A and 19B illustrate the cutting elements 14 shown in FIG. 18, and a retainer 44 that is positioned in the cavity 12. The retainer 44 illustrated in FIG. 19A comprises a peg and a spring, wherein the spring is disposed between the wall 26 of the cavity 12 and the peg. The retainer 44 illustrated in FIG. 19B comprises a threaded setscrew engaged with threads formed on the wall 26 of the cavity 12. Like in FIGS. 10A and 10B, the retainer 44 is movable between a first position, wherein the retainer 44 is engaging the concave depression 54, and a second position, wherein the retainer 44 is offset from the lateral surface 51 of the substrate 22 so that the cutting element 14 can be released from the blade 10. For example, the retainer 44 may be pushed from the first position into the second position with an elongated tool that has been introduced in the through-hole 52. Alternatively, the retainer 44 may be screwed with an elongated tool that has been introduced in the through-hole 52. Regardless of whether the retainer 44 is pushed or screwed, the retainer 44 allows a quick assembly and disassembly of the cutting element 14, such that repair of a worn cutting element is easy and fast. Because the width of the through-hole 52 is smaller than the width of the corners 62, the retainer 44 can remain entirely trapped in the concave depression 54, even after failure. Accordingly, portions of the retainer 44 may not fall in the well being drilled where these portions could cause damage to the bit or other drilling components.

Figure 20:
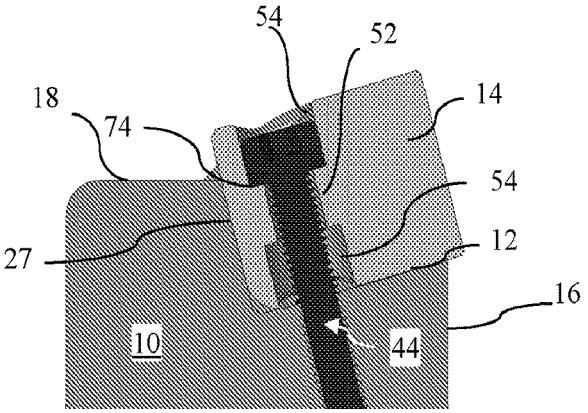
FIG. 20 is a perspective view of a portion of an earth-boring bit that illustrates another example method for mounting cutting elements such as shown in FIG. 18.

FIG. 20 illustrates the cutting elements 14 shown in FIG. 18, and a retainer 44 that is positioned against the shoulder 74 and attached to (e.g., threaded into) the blade 10. Unlike the retainer shown in FIGS. 12 and 19B, the retainer 44 needs to be removed from the cavity 12 so that the cutting element 14 can be released from the blade 10. Unlike the retainer shown in FIGS. 19A and 19B, after the failure of the retainer 44, portions of the retainer 44 may fall in the well being drilled.

Figure 22A:
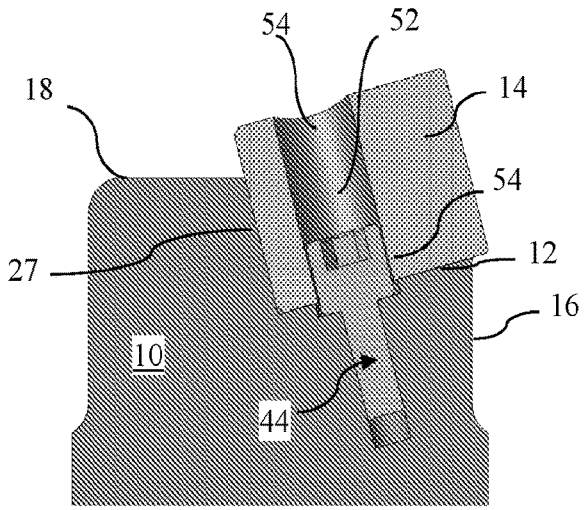
FIGS. 22A-22B are sectional views of a portion of an earth-boring bit that illustrate an example method for mounting cutting elements such as shown in FIG. 21.
Figure 22B:
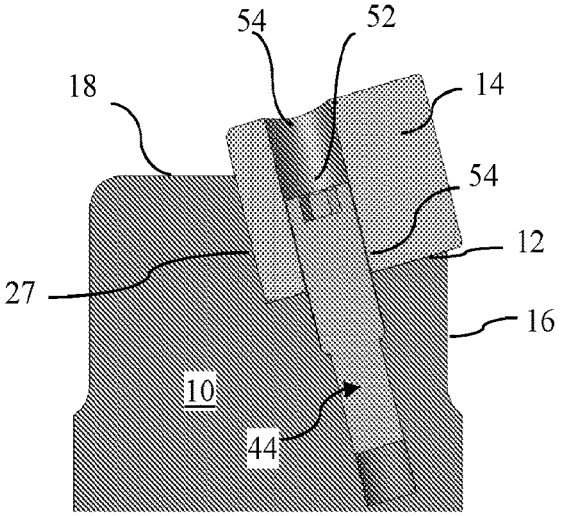

FIGS. 22A-22B illustrate the cutting elements 14 shown in FIG. 21, and a retainer 44 that is attached to (e.g., threaded into) the blade 10. Again, the retainer 44 needs to be removed from the cavity 12 so that the cutting element 14 can be released from the blade 10. To allow the positioning of the retainer 44, the width of the through-hole 52 is dimensioned to be larger than the width of the retainer 44. Therefore, to receive a retainer 44 having a similar width as the retainer shown in FIG. 19B or 20, the width of the through-hole 52 located in the substrate 22 of the cutting elements 14 is larger than the width of the cutting elements 14 shown in FIG. 19B or 20, which may weaken the cutting elements 14 compared to other designs. However, the risk of failure of the retainer 44 may be lower compared to other designs.

Preferably, the retainer 44 shown in FIGS. 19A-19B, 20, and 22A-22B are dimensioned such that the retainer 44 is not required to resist the cutting compression forces applied in the direction of the longitudinal axis 24. Instead, these cutting compression forces are transmitted by the substrate 22 or the cutting element 14 to a back surface 27 of the wall of the cavity 12. A purpose of the retainer 44 may be to avoid the cutting elements 14 from falling off through the opening in the leading face 16 of the blade 10.

What is claimed is:

1. An earth-boring bit comprising:

a body having a rotational axis;

a blade extending axially and radially from the body, the blade having a leading face and an edge;

a cavity formed in the blade, the cavity leading to a first opening in the edge of the blade, the cavity leading to a second opening in the leading face of the blade;

the cavity being configured to receive a cutting element and a retainer through the first opening, the cutting element having a cylindrical lateral surface and a flared lateral surface that points inwards in a direction toward a cutting face of the cutting element, a portion of a wall of the cavity being complementary to a shape of the flared lateral surface of the cutting element;

wherein the cutting element is prevented from rotating inside the cavity after the flared lateral surface of the cutting element is engaged with the portion of the wall of the cavity;

wherein the cavity is configured to receive the retainer after the cutting element is engaged with the portion of the wall of the cavity such that the retainer is capable of abutting the cutting element and a back wall of the cavity; and wherein the retainer is releasably attached to the blade.

2. The earth-boring bit of claim 1, wherein the cutting element consists of a table of sintered polycrystalline diamond from which a transition metal used as a sintering catalyst is essentially entirely leached or otherwise removed from the pores of a polycrystalline diamond matrix that are connected to an outer surface of the table.

3. The earth-boring bit of claim 1, wherein the retainer comprises a shim releasably attached to the blade by using a screw, an adhesive, or brazing.

4. The earth-boring bit of claim 1, wherein the cutting element has a rotational symmetry of order two or more around a longitudinal axis.

5. The earth-boring bit of claim 1, wherein the portion of the wall of the cavity fills up the shape of the flared lateral surface of the cutting element.

6. The earth-boring bit of claim 1, wherein the cutting element is prevented from rotating inside the cavity after the flared lateral surface of the cutting element interlocks with the portion of the wall of the cavity; wherein the cavity is configured to receive the retainer after the cutting element interlocks with the portion of the wall of the cavity such that the retainer is capable of abutting the cutting element and a back wall of the cavity.

7. An earth-boring bit comprising:

a body having a rotational axis;

a blade extending axially and radially from the body, the blade having a leading face and an edge;

a cavity formed in the blade, the cavity leading to a first opening in the edge of the blade, the cavity leading to a second opening in the leading face of the blade;

the cavity being configured to receive a cutting element, the cutting element including an ultra-hard table attached to a substrate, the substrate having a lateral surface portion forming a keyseat, a lateral surface portion that is cylindrical, a lateral surface including a concave depression, the concave depression being surrounded by a corner, and an entirety of the ultra-hard table having a circular perimeter;

a portion of a wall of the cavity configured to form a complementary key such that the cutting element is prevented from rotating inside the cavity after the keyseat is engaged with the key;

a retainer that is releasably attached to the blade, the retainer being positioned in the cavity and movable between a first position wherein the retainer is engaging the concave depression so that the cutting element is mechanically retained in the blade, and a second position wherein the retainer is offset from the concave depression so that the cutting element can be released from the blade; and a through-hole formed in the substrate of the cutting element, the through-hole leading to the concave depression.

8. The earth-boring bit of claim 7, wherein the retainer can be moved from the first position to the second position with an elongated tool penetrating the through-hole.

9. The earth-boring bit of claim 7, wherein the retainer comprises a ball or peg and a spring, the spring being disposed between the wall of the cavity and the ball or peg, or wherein the retainer comprises a threaded setscrew engaged with threads formed on the wall of the cavity.

10. The earth-boring bit of claim 7, wherein the cutting element has a rotational symmetry of order two or more around a longitudinal axis.

11. The earth-boring bit of claim 7, wherein the keyseat fills in the portion of the wall of the cavity such that the cutting element is prevented from rotating inside the cavity after the keyseat interlocks with the key.

12. An earth-boring bit comprising:

a body having a rotational axis;

a blade extending axially and radially from the body, the blade having a leading face and an edge;

a cavity formed in the blade, the cavity leading to a first opening in the edge of the blade, the cavity leading to a second opening in the leading face of the blade, the cavity having a wall, the cavity receiving a portion of a cutting element, the cutting element protruding from the cavity through the first opening and through the second opening; the cutting element including an ultra-hard table attached to a substrate, the substrate having a lateral surface, the lateral surface including a concave depression, the concave depression being surrounded by a corner;

a retainer positioned in the cavity and movable between a first position wherein the retainer is engaging the concave depression so that the cutting element is mechanically retained in the blade, and a second position wherein the retainer is offset from the lateral surface of the substrate so that the cutting element can be released from the blade;

a through-hole formed in the substrate of the cutting element and leading to the concave depression;

wherein the retainer comprises a ball or peg and a spring, the spring being disposed between the wall of the cavity and the ball or peg, or wherein the retainer comprises a threaded setscrew engaged with threads formed on the wall of the cavity;

whereby the retainer can be moved from the first position to the second position with an elongated tool penetrating the through-hole.

13. An earth-boring bit comprising:

a body having a rotational axis;

a blade extending axially and radially from the body, the blade having a leading face and an edge;

a cavity formed in the blade, the cavity leading to a first opening in the edge of the blade, the cavity leading to a second opening in the leading face of the blade, the cavity having a wall, the cavity receiving a portion of a cutting element, the cutting element protruding from the cavity through the first opening and through the second opening;

the cutting element including an ultra-hard table attached to a substrate, the substrate having a lateral surface, the lateral surface including a concave depression, the concave depression being surrounded by a corner;

a retainer positioned in the cavity and movable between a first position wherein the retainer is engaging the concave depression so that the cutting element is mechanically retained in the blade, and a second position wherein the retainer is offset from the lateral surface of the substrate so that the cutting element can be released from the blade;

a through-hole formed in the blade and leading to the cavity and the retainer;

wherein the retainer comprises a threaded setscrew engaged with threads formed on the wall of the cavity;

whereby the retainer can be moved from the first position to the second position with an elongated tool penetrating the through-hole.

* * * * *